US005916277A

United States Patent [19]

Dallas

[11] Patent Number: 5,916,277

[45] Date of Patent: Jun. 29, 1999

[54] MULTI-FUNCTION TOOL WITH REMOVABLE HEAD

[75] Inventor: Edgar A. Dallas, Beaverton, Oreg.

[73] Assignee: Fiskars Inc., Madison, Wis.

[21] Appl. No.: 08/889,241

[22] Filed: Jul. 8, 1997

[51] Int. Cl.[6] ..... B25B 7/22

[52] U.S. Cl. ..... 7/128; 7/128; 7/168; 30/143; 81/177

[58] Field of Search ..... 7/106, 128, 168; 30/143; 81/177

[56] References Cited

U.S. PATENT DOCUMENTS

| | | | |
|---|---|---|---|
| 614,537 | 11/1898 | Dahlquist . | |
| 677,770 | 7/1901 | Koeth . | |
| 790,432 | 5/1905 | Heilrath . | |
| 1,101,181 | 6/1914 | Hayden . | |
| 1,144,210 | 5/1915 | Kincaid . | |
| 1,374,807 | 4/1921 | Beaty . | |
| 1,439,404 | 12/1922 | Cotharin . | |
| 1,509,165 | 10/1924 | Montero . | |
| 1,522,695 | 1/1925 | Noreen . | |
| 2,341,375 | 2/1944 | Hambleton . | |
| 2,588,162 | 7/1952 | Riggio . | |
| 2,806,282 | 9/1957 | Berg | 30/143 |
| 2,828,855 | 4/1958 | Mosch . | |
| 3,044,081 | 7/1962 | Robinson, Jr. . | |
| 3,132,550 | 5/1964 | Sion . | |
| 3,603,782 | 9/1971 | Wortmann . | |
| 4,122,569 | 10/1978 | Hitchcock . | |
| 4,409,866 | 10/1983 | McBride . | |
| 4,451,982 | 6/1984 | Collins . | |
| 4,573,268 | 3/1986 | Call . | |
| 4,648,145 | 3/1987 | Miceli . | |
| 4,794,692 | 1/1989 | Wang . | |
| 4,918,775 | 4/1990 | Leu . | |
| 4,958,395 | 9/1990 | Busskohl . | |
| 4,960,016 | 10/1990 | Seals . | |
| 5,062,173 | 11/1991 | Collins et al. . | |
| 5,136,744 | 8/1992 | Allsop et al. | 7/106 |
| 5,142,721 | 9/1992 | Sessions et al. . | |
| 5,212,844 | 5/1993 | Sessions et al. . | |
| 5,313,376 | 5/1994 | McIntosh . | |
| 5,432,968 | 7/1995 | Beck . | |
| 5,510,962 | 4/1996 | Hsiao . | |
| 5,515,249 | 5/1996 | Shiao . | |

FOREIGN PATENT DOCUMENTS

| | | |
|---|---|---|
| 861380 | 12/1952 | Germany . |
| 29708077 | 10/1997 | Germany . |
| 775758 | 5/1957 | United Kingdom . |
| WO8804221 | 6/1988 | WIPO . |

OTHER PUBLICATIONS

Ad brochure page entitled "The Most Serious Multi–Tool Ever Made" by Coast Cutlery; date unknown.

*Primary Examiner*—James G. Smith
*Assistant Examiner*—Shantese McDonald
*Attorney, Agent, or Firm*—Foley & Lardner

[57] ABSTRACT

A multi-function tool includes a caddy and a cover pivotally connected to the caddy. The tool includes a primary implement attached to a first end of the caddy, and a plurality of secondary implements pivotally attached about a second end of the caddy. The secondary implements may be held in an extended position by a locking mechanism, a portion of which extending from a longitudinal slot formed in at least one side of the caddy. The cover may also include a light disposed about an end thereof.

22 Claims, 7 Drawing Sheets

MULTI-FUNCTION TOOL WITH REMOVABLE HEAD

FIELD OF THE INVENTION

This invention relates to a pocket tool having a primary implement and a plurality of secondary implements. More particularly, the present invention relates to a multi-function tool which includes a removable wrench or pair of pliers. The present invention further relates to a pocket tool provided with a light, a locking mechanism for attaching the primary implement to the pocket tool, and a locking mechanism for retaining at least one of the secondary implements in an extended position.

BACKGROUND OF THE INVENTION

In general, multi-function tools, including in a single instrument, pliers, and other selected tools, such as screwdrivers, knife blades, files and the like are well known. Many prior art multi-function tools include a main tool and several auxiliary tools. For example, in U.S. Pat. No. 4,122,569 issued on Oct. 31, 1978 to Thomas H. Hitchcock, a crescent wrench is provided with multiple tools pivotally attached to a universal joint located at an opposite end of the wrench. Other multi-function tools include a pair of cross-jaw pliers with channel-shaped handles, and a plurality of auxiliary tools that are pivotally connected to the handles. The plier jaws include respective tangs that are slidably affixed to the respective handles, so that the jaws may be slidably retracted into the handles. Examples of such multiple tools are described in U.S. Pat. Nos. 5,142,721 and 5,212,844 issued on Sep. 1, 1992 and May 25, 1993, respectively, to George C. Sessions et al.

In these multi-function tools, however, the main tool is permanently attached to the body of the multi-function tool. In certain circumstances it may be desirable to replace one main tool with another. Since only one main tool is provided in the multi-function tool, a full-size version of another tool must also be brought along, when required.

In addition, in some multi-function tools the auxiliary tools are not fully enclosed when in their retracted position, thereby providing an uneven surface for the user to grip when handling the tool. Alternatively, other multi-function tools may be equipped with a pair of handles into which the auxiliary tools are folded. This tends to make the tool bulky and difficult to manage.

Another feature present in certain multi-function tools is an integral spring formed in the region of the handle proximate the pivotally attached ancillary tools. The integral spring cooperates with a surface of each selected ancillary tool to lock the selected tool in an extended position. The selected tool is released by application of sufficient pressure to the working portion of the ancillary tool to overcome the spring force of the integral spring.

An attempt has been made, by the assignee of the present invention in U.S. Ser. No. 08/771,449 filed on Dec. 20, 1996, to provide a locking mechanism for retaining an ancillary tool in an extended, working position. The locking mechanism includes a pair of buttons for releasing the ancillary tool from the extended position. The buttons project from the top and bottom of the tool. However, this approach may increase the size of the tool beyond that desired by a user.

In light of the foregoing, it is desirable to provide a multi-function tool in which a primary implement may be easily attached to and removed from a caddy or handle. In addition, it is desirable to provide a locking mechanism for attaching the primary tool to the caddy. Another desirable feature is to provide a compact enclosure for housing the secondary tools. Moreover, it is desirable to provide a simple locking mechanism that is not susceptible to being accidentally released for retaining the secondary tools in an extended position. Finally, it is further desirable to provide a light on the multi-function tool for illuminating a work area.

SUMMARY OF THE PRESENT INVENTION

A multi-function tool in accordance with one aspect of the present invention includes a caddy and a cover pivotally connected to the caddy. The caddy includes first and second ends and an internal channel. The cover is rotatable between an open position in which the internal channel is exposed and a closed position in which the internal channel is covered. In addition, the cover includes a light disposed about an end thereof.

In accordance with another aspect of the invention, a multi-function tool is provided with a caddy having first and second ends, a web, and a pair of side walls which extend from the web to form an internal channel. The tool further includes a cover pivotally connected to the caddy and a primary implement attached to the first end of the caddy. The cover is rotatable between an open position in which the internal channel is exposed and a closed position in which the internal channel is covered.

In accordance with still another aspect of the invention, a multi-function tool includes a caddy and a cover pivotally connected to the caddy. The cover is rotatable between open and closed positions for exposing and covering the internal channel, respectively. The caddy has first and second ends, a web and a pair of side walls. At least one side wall has a longitudinal slot proximate the second end. The tool also includes a primary implement which is removably attached to the first end of the caddy and a plurality of secondary implements. In addition, the tool is provided with a locking mechanism for locking the secondary implements in an extended position, a portion of the locking mechanism extending through a longitudinal slot formed in the caddy.

Other principal features and advantages of the invention will become apparent to those skilled in the art upon review of the following drawings, the detailed description and the appended claims.

BRIEF DESCRIPTION OF THE DRAWINGS

The present invention will become more fully understood from the following detailed description, taken in conjunction with the accompanying drawings, wherein like reference numerals denote like elements, in which.

DETAILED DESCRIPTION OF A PREFERRED EXEMPLARY EMBODIMENT

Figure 1:
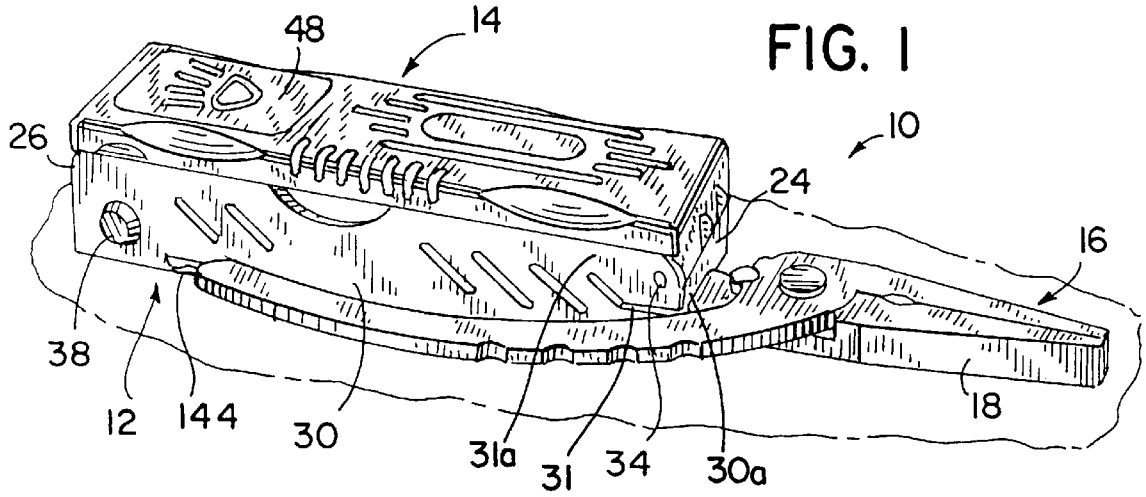
FIG. 1 is an isometric view of the multi-function tool of the present invention in a closed position showing a cover, a caddy and a pair of pliers.
Figure 2:
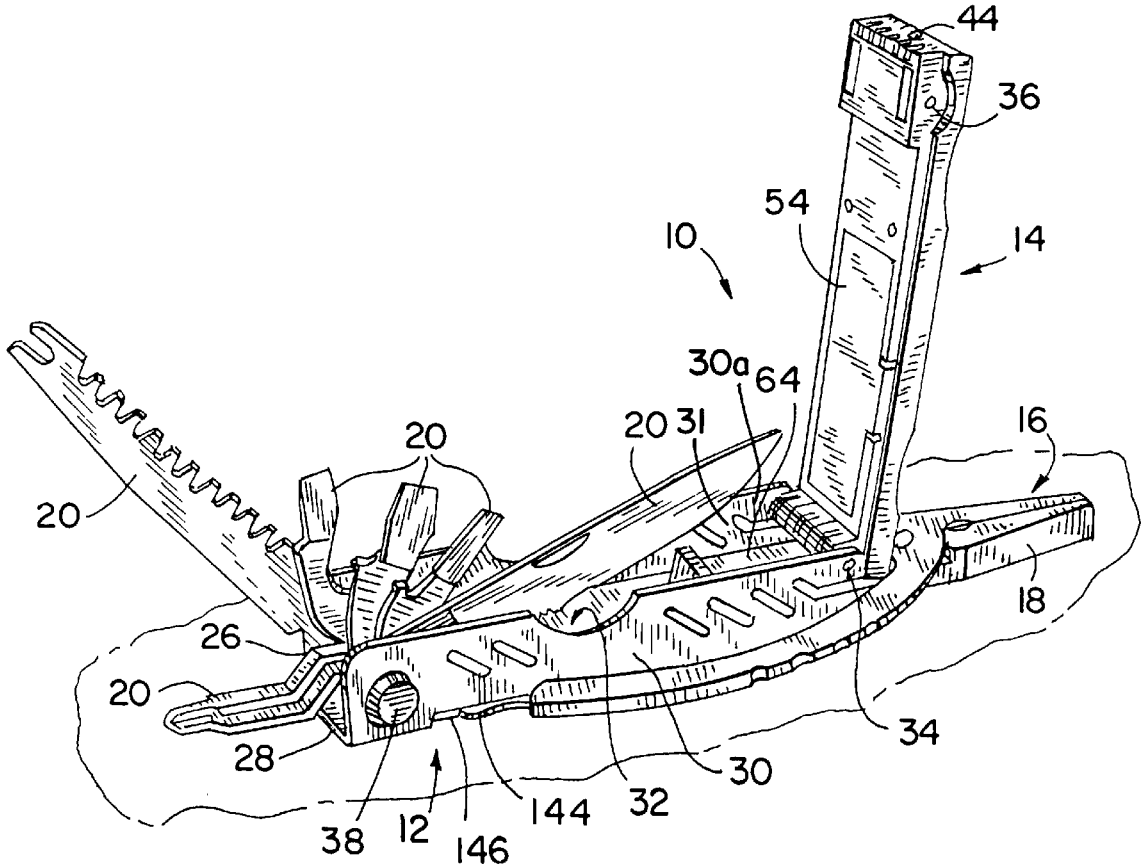
FIG. 2 is an isometric view of the multi-function tool in an open position with secondary implements exposed for viewing.

Referring generally to FIGS. 1 and 2, an exemplary multi-function tool 10 in accordance with the present invention is provided. Tool 10 includes a caddy 12, a cover 14, a modular primary implement 16, shown here as a pair of needle-nose pliers 18, and a plurality of secondary implements 20. In addition to needle-nose pliers 18, primary implement 16 may also be a crescent wrench 22 (FIG. 17) or slip-joint pliers (not shown). Tool 10 has a first end 24 from which primary implement 16 extends and a second end 26 about which secondary implements 20 are pivotally attached. Caddy 12 includes a web 28 connecting a pair of side walls 30 to form an internal channel 32. Internal channel 32 of caddy 12 houses secondary implements 20 when not in use. At first end 24 cover 14 is pivotally coupled to caddy 12 and movable between a closed position in which internal channel 32 is concealed (FIG. 1) and an open position in which internal channel 32 is exposed (FIG. 2). Moreover, in the preferred embodiment cover 14 may be fully detached from caddy 12.

Figure 3:
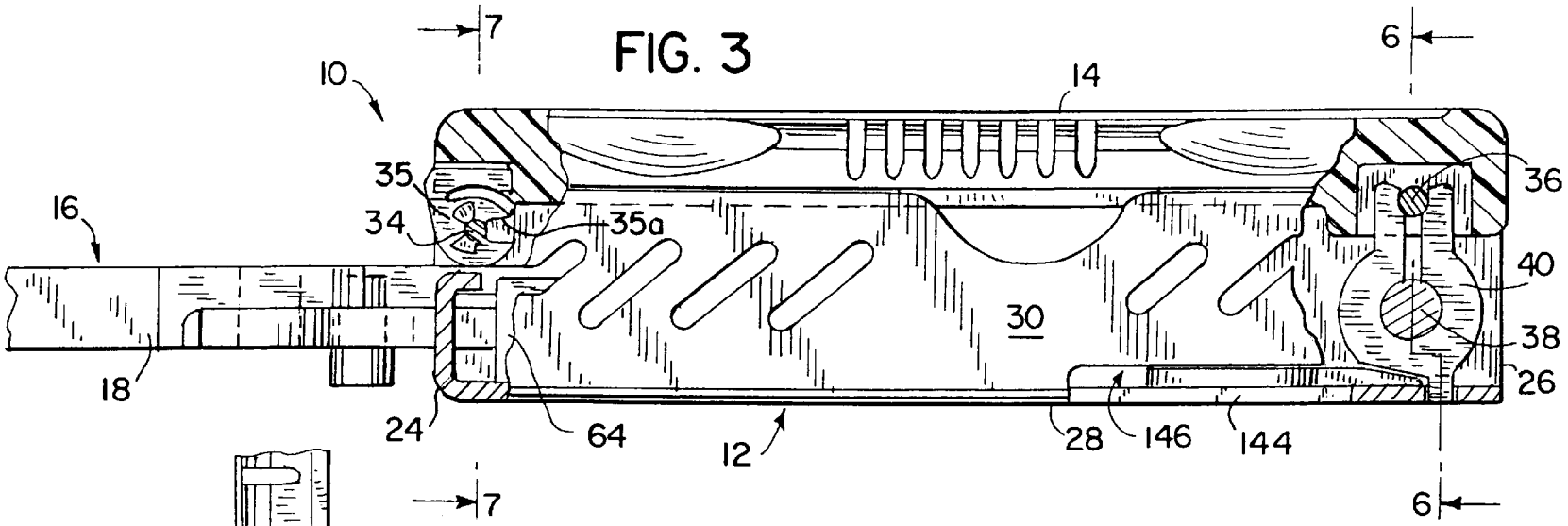
FIG. 3 is a partial side view of the multi-function tool with the ends of the cover and caddy cut away for purposes of illustration.
Figure 5:
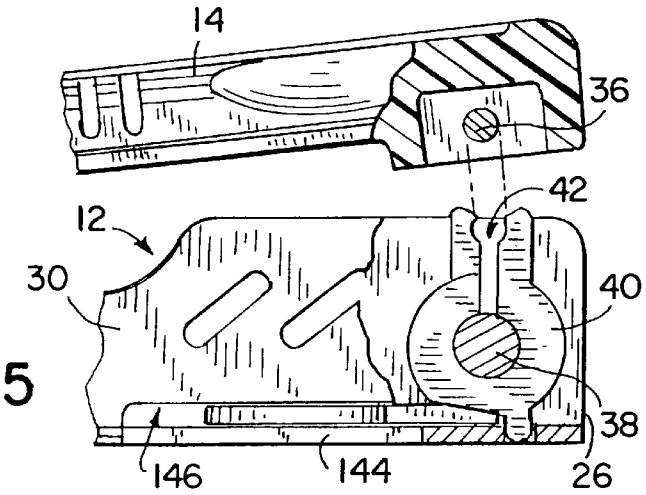
FIG. 5 is a partial sectional view of the second end of the multi-function tool shown in FIG. 3, with the cover being installed to the caddy.
Figure 4:
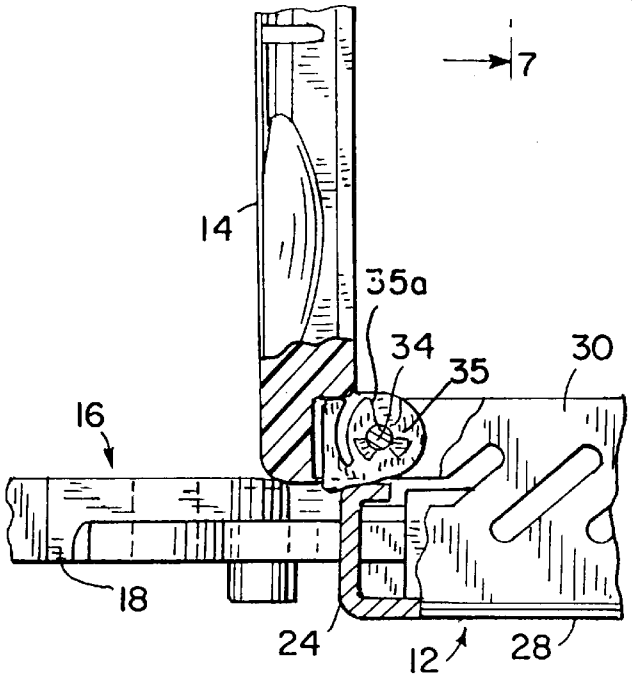
FIG. 4 is a partial sectional view of the first end of the multi-function tool shown in FIG. 3, with the cover pivotally attached to the caddy.

Referring to FIGS. 3–5 the connection between cover 14 and caddy 12 will be described in greater detail. Cover 14 is pivotally connected to caddy 12 at first end 24 and releasably attached at second end 26. Proximate first end 24 of tool 10, a hinge pin 34 extends transversely between side walls 30 of cover 14 and caddy 12, enabling cover 14 to rotate about hinge pin 34. Proximate second end 26 a pair of latch pins 36 are disposed proximate second end 26 of cover 14. Caddy 12 also includes an axle 38 which extends transversely between side walls 30 proximate second end 26. Located along axle 38 is a pair of latch spacers 40. Each latch spacer 40 has an opening 42 for engaging a respective latch pin 36 to retain cover 14 in the closed position.

Figure 6:
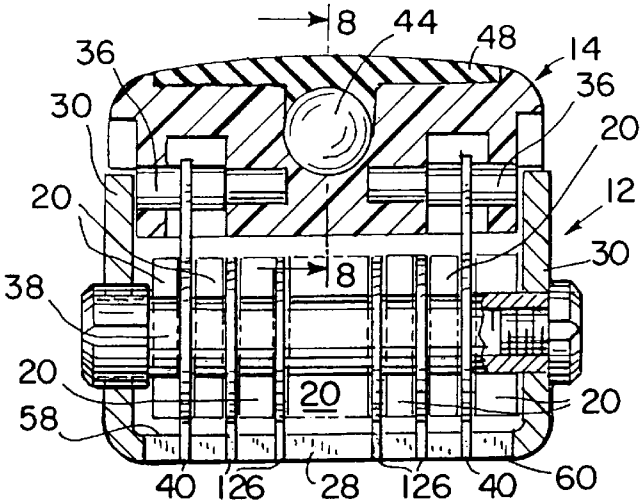
FIG. 6 is a cross-sectional view taken generally along line 6—6 of FIG. 3.
Figure 8:
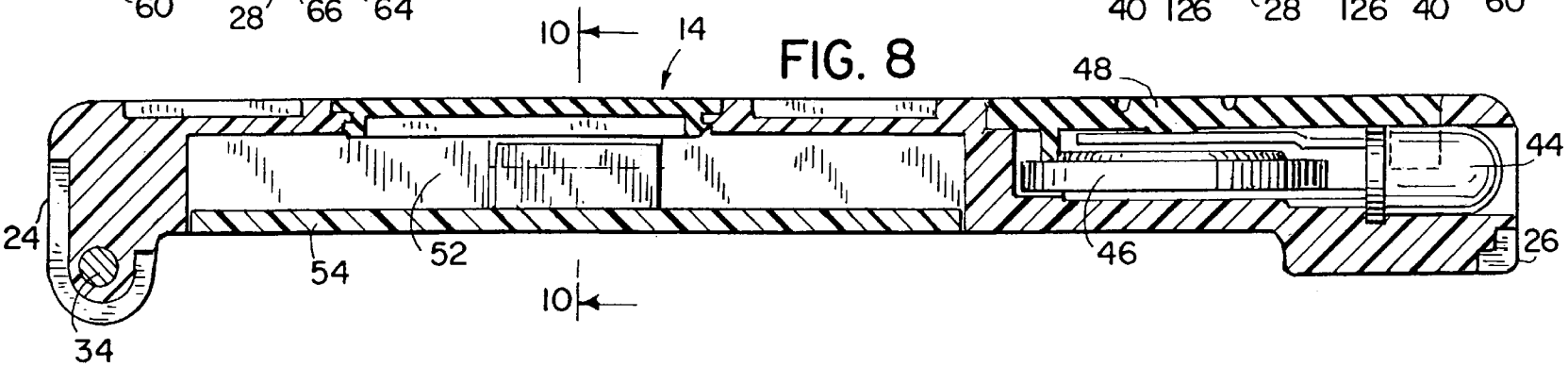
FIG. 8 is a cross-sectional view taken generally along line 8—8 of FIG. 6.
Figure 9:
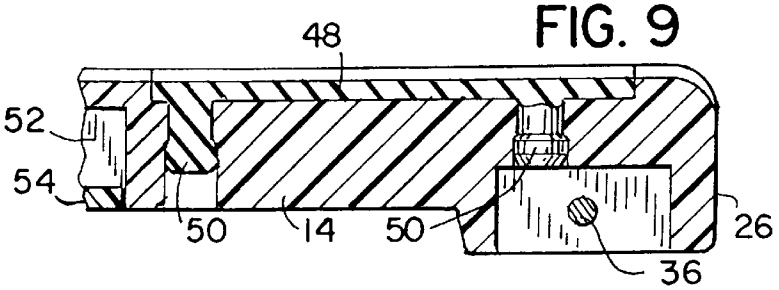
FIG. 9 is a partial sectional view of the cover showing the attachment of a light button.

Cover 14 is preferably made of a durable plastic material and may be injection molded. As shown in FIGS. 6 and 8, second end 26 of cover 14 includes a light source 44 which may provide light to an area on which a secondary implement 20 is applied. In addition, since cover 14 is fully detachable from caddy 12, cover 14 may also be used as a separate flashlight. Light source 44 is preferably a super bright light emitting diode, but may also be any other miniature light bulb. Light source 44 is powered by a dry cell battery 46 located in cover 14. A button 48 mounted in cover 14 above battery 46 provides a momentary switch action when depressed, thereby activating light source 44. Button 48 may also be made of an injection moldable plastic, such as Kraton®, and includes feet 50 which are press fit into grooves in cover 14, as illustrated in FIG. 9.

Figure 10:
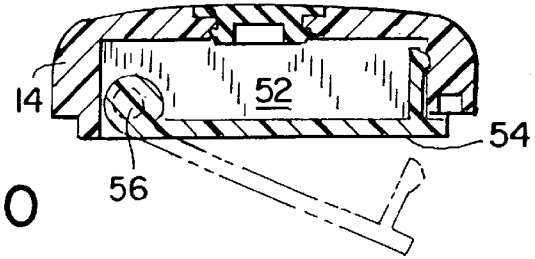
FIG. 10 is a cross-sectional view taken generally along line 10—10 of FIG. 8.

As shown in FIGS. 8 and 10, cover 14 also has an internal compartment 52 formed therein. Compartment 52 generally extends the remainder of the length of cover 14 not occupied by light source 44 and battery 46. Internal compartment 52 may be used to store smaller items, such as matches. A hatch 54, preferably made of the same plastic material as cover 14, provides access to compartment 52. Hatch 54 is pivotally attached to cover 14 by a hinge pin 56 and is rotatable between a closed position, shown in solid lines, and an open position, shown in dashed lines (FIGS. 10).

Figure 7:
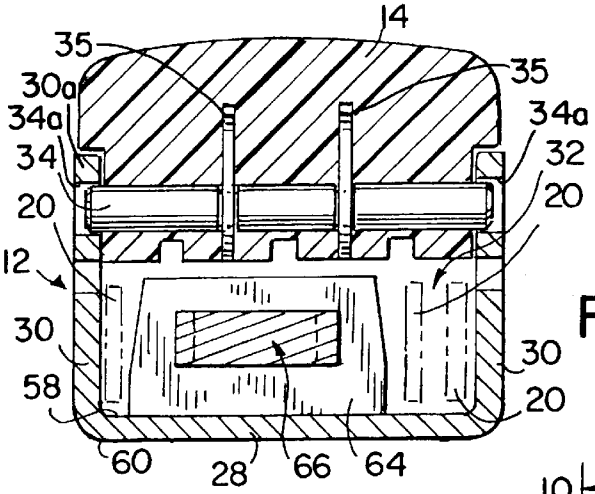
FIG. 7 is a cross-sectional view taken generally along line 7—7 of FIG. 3.
Figure 11:
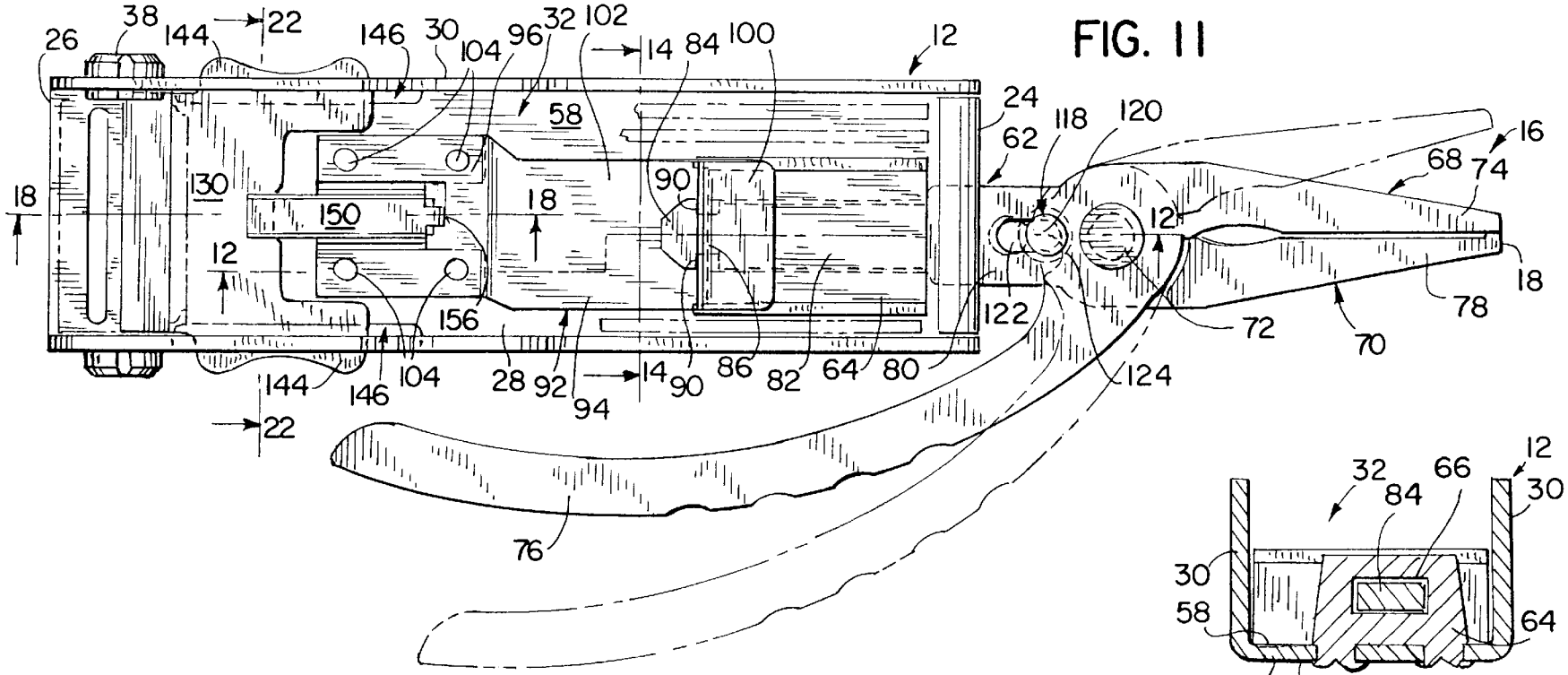
FIG. 11 is a plan view of the multi-function tool with the cover and secondary implements removed.
Figure 12:
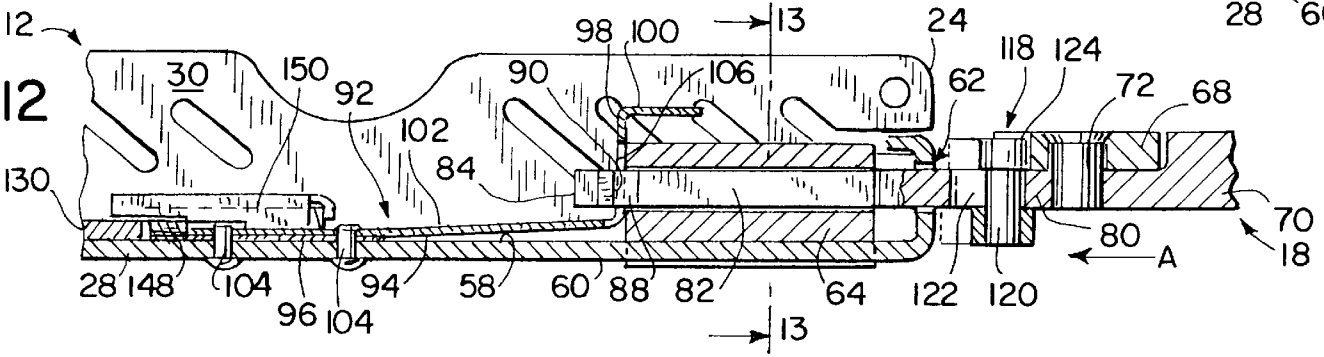
FIG. 12 is a cross-sectional view taken generally along line 12—12 of FIG. 11.

As discussed above, caddy 12 has web 28 extending between which side walls 30 to form internal channel 32 (FIG. 7). Web 28 is generally flat and has a top surface 58 and a bottom surface 60. Caddy 12 is preferably made of a corrosion-resistant material such as stainless steel and may be stamped from a sheet of stainless steel. First end 24 of caddy 12 has an aperture 62 formed therein (FIGS. 11 and 12). Caddy 12 also includes a socket 64 which is mounted to web 28 and projects into internal channel 32. Socket 64 is preferably made of stainless steel and has a channel 66 of a predetermined length. The opening of channel 66 aligns with aperture 62 of caddy 12. As will be explained in greater detail below, both aperture 62 and socket 64 receive primary implement 16, when primary implement 16 is attached to caddy 12.

As best shown in FIGS. 1, 2, 3, 4, 7 and 12, means are provided for facilitating the removal or detachment of the cover 14 from the caddy 12. To this end, and in the present instance the side walls 30, adjacent the first end 24 of the caddy, include a slot or cut 31 therein, terminating in a reduced section 31*a* to form ears 30*a*. Each ear 30*a* includes an aperture 34*a* (see FIG. 7). Pin 34, is captured and retained in the cover by retainer clips 35 and affords a snap-in and snap-out connection of the cover 14 to and from the apertures 34*a*.

As has been noted above, the caddy 12 is preferably composed of a corrosion-resistant material, e.g. stainless steel, and because of the inherent qualities of this material, the ears 30*a*, because of the reduced sections 31*a*, are resilient or spring like about the reduced section. The inherent resilience of the ears 30*a* in the walls 30 allow for a twisting action of the cover 14. When this occurs the pin 34 acts against the apertures 34*a* to effect a camming action facilitating outward deflection of the ears and allowing for detachment of the cover 14 from the caddy. Replacing the cover 14 may occur simply by reversing the action.

Referring now to FIG. 11, pliers 18 have opposing jaw pieces 68 and 70 that are interconnected by a pivot pin or bearing 72. Jaw piece 68 includes a working portion 74 extending forward of pivot pin 72 and a handle 76 extending aft of pivot pin 72. Jaw piece 70 includes a working portion 78 which corresponds with working portion 74 of jaw piece 68. Extending aft of pivot pin 72, jaw piece 70 has a tang 80 for attaching pliers 18 to caddy 12.

Figure 13:
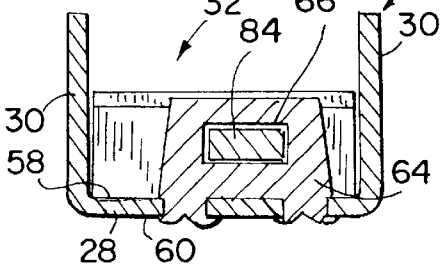
FIG. 13 is a cross-sectional view taken generally along line 13—13 of FIG. 12.
Figure 17:
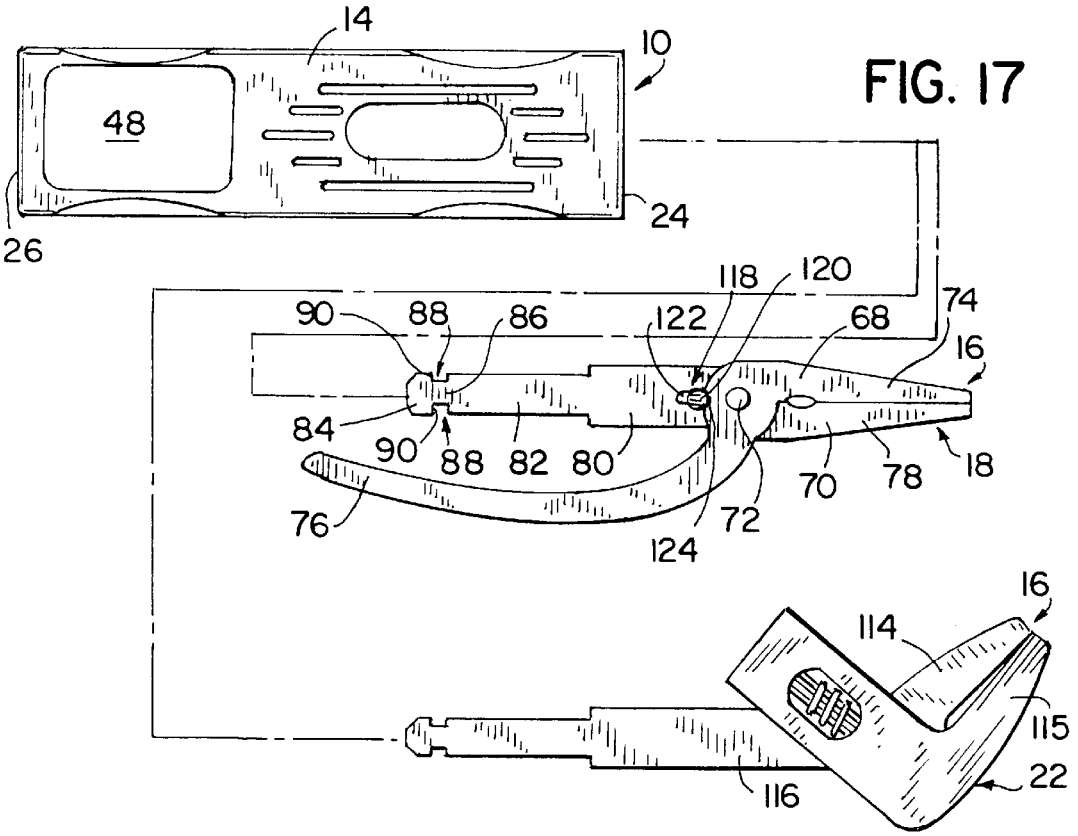
FIG. 17 is a partially exploded view of the multi-function tool showing a couple of tools that may be attached to the first end.

As illustrated in FIGS. 11 and 17, tang 80 of pliers 18 has a post 82 of a predetermined length. Post 82 is narrower in width than tang 80 and is designed to be received in channel 66 of socket 64 (FIG. 13). Located at the end of post 82 is a generally arrow-shaped tip 84. Post 82 has a notch region 86 formed by a pair of notches 88 adjacent tip 84. Notches 88 provide tip 84 with a back surface 90. As will be explained in greater detail below, tang post 82 engages a locking mechanism 92 to attach pliers 18 to caddy 12.

Locking mechanism 92, shown in FIGS. 11 and 12, includes a lock spring 94 that is mounted to top surface 58 of web 28. Spring 94 is preferably stamped from a sheet of stainless steel and has a base portion 96, a tang receiving portion 98, a tab 100, and a sloping region 102 extending between base portion 96 and tang receiving portion 98. Base portion 96 is preferably secured to web 28 by rivets 104. In the alternative, base portion 96 may be welded or otherwise attached to web 28. Tang receiving portion 98 extends transversely between side walls 30 of caddy 12 and is biased towards cover 14 by sloping region 102. Tang receiving portion 98 has an opening 106 formed therein.

Figure 14:
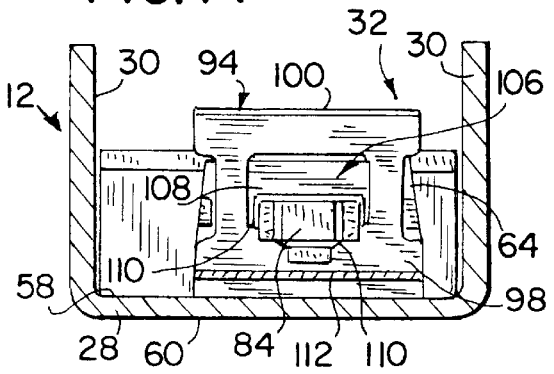
FIG. 14 is a cross-sectional view taken generally along line 14—14 of FIG. 11.
Figure 16:
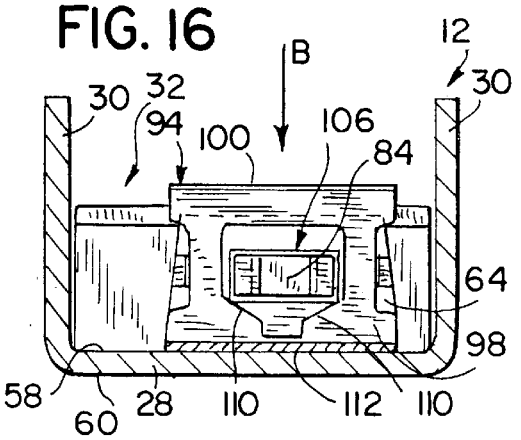
FIG. 16 is a cross-sectional view taken generally along line 16—16 of FIG. 15.

Opening 106 of tang receiving portion 98 of spring 94 has a length slightly larger than that of channel 66 of socket 64. As shown in FIGS. 14 and 16, opening 106 includes an upper, generally rectangular portion 108. Extending from the lower corners of rectangular portion 108 are inward slanting edges 110 which meet along bottom edge 112. Bottom edge 112 has a length approximately the width of notch region 86 of tang post 82.

Figure 15:
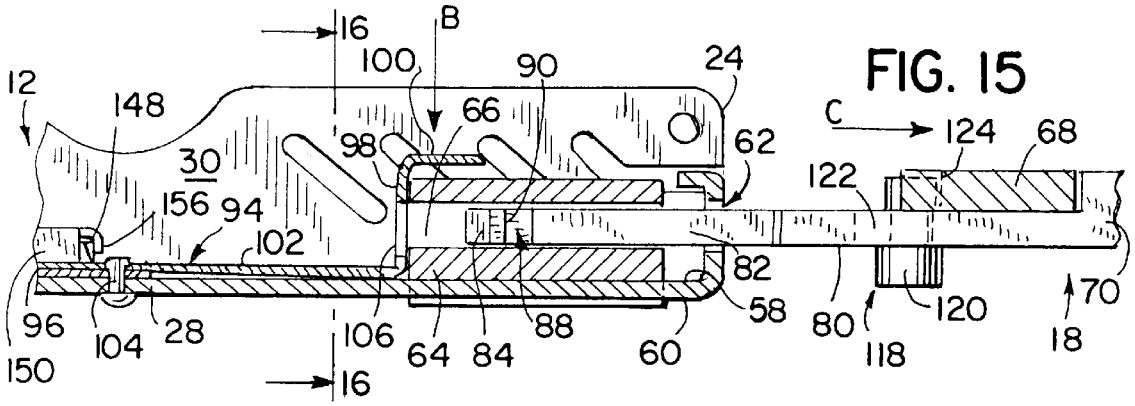
FIG. 15 is a partial sectional view of the first end of the multi-function tool showing the pliers being removed from the caddy.

Thus, pliers 18 are secured to caddy 12 as follows. Tang post 82 is inserted through aperture 62 of caddy 12 and into channel 66 of socket 64, as shown by arrow A in FIG. 12. As arrow-shaped tip 84 of post 82 exits channel 66 of socket 64, tip 84 enters opening 106 of lock spring 94 and contacts slanted edges 110, forcing spring 94 down toward web 28, so that tip 84 may pass through rectangular portion 108. Spring 94 returns to its normal, resting position when tip 84 is completely past opening 106. At this point, tang receiving portion 98 of spring 94 contacts back surface 90 of tip 84 to prevent pliers 18 from being removed from caddy 12 (FIG. 14). Pliers 18 may be detached from caddy 12, by depressing tab 100 of spring 94 in the direction indicated by arrow B in FIGS. 15 and 16. When spring 94 is depressed, tip 84 may pass through rectangular portion 108, pliers 18 may be removed from caddy 12 by pulling in the direction of arrow C of FIG. 15.

As shown in FIG. 17, in addition to pliers 18, another primary implement 16 is crescent wrench 22. Wrench 22 has a working portion 114 located at one end of wrench 22 and a tang 116 at the other end. Another working portion 115 is slidably coupled to tang 116 and mates with working portion 114. Tang 116 is identical to tang 80 of pliers 18. Accordingly, wrench 22 is attached to caddy 12 in the same manner as pliers 18. Additional primary implements (not shown) with tangs similar to tangs 80 and 116 may be interchanged with caddy 12.

Pliers 18 also include a lock 118 for maintaining working portions 74 and 78 of jaw pieces 68 and 70, respectively, together in a closed position. As best illustrated in FIGS. 11 and 12, lock 118 includes a post 120 that is slidably received in a slot 122 formed in tang 80 of jaw piece 70. Jaw piece 68 has a notch 124 located in the vicinity of pivot pin 72. Notch 124 aligns with a portion of slot 122 when working portions 74 and 78 of respective jaw pieces 68 and 70 are together. Post 120 may be moved toward pivot pin 72 to engage notch 124 of jaw piece 68, thereby retaining pliers 18 in the closed position. To unlock pliers 18, post 120 is moved out of notch 124, away from pivot pin 72. Pliers 18 may then be opened as shown in dashed lines in FIG. 11.

Figure 18:
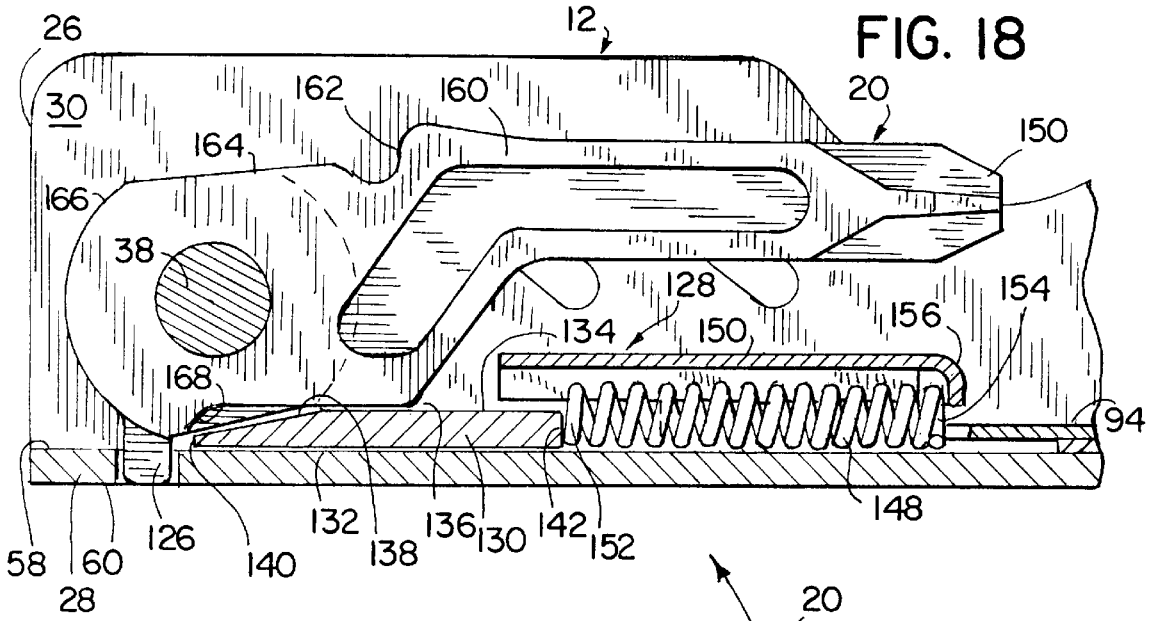
FIG. 18 is a cross-sectional view taken generally along line 18—18 of FIG. 11 and illustrating the locking mechanism for the secondary implements.
Figure 19:
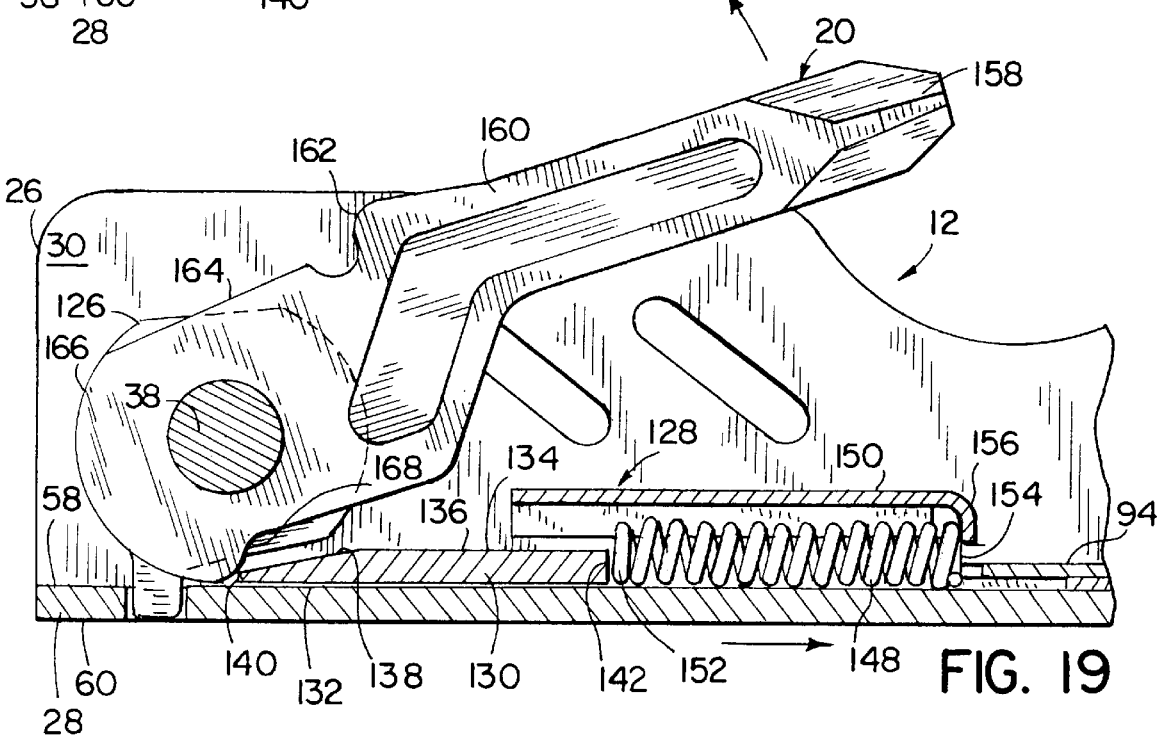
FIG. 19 is a partially sectional view of the locking mechanism showing a secondary implement in a slightly extended position.
Figure 22:
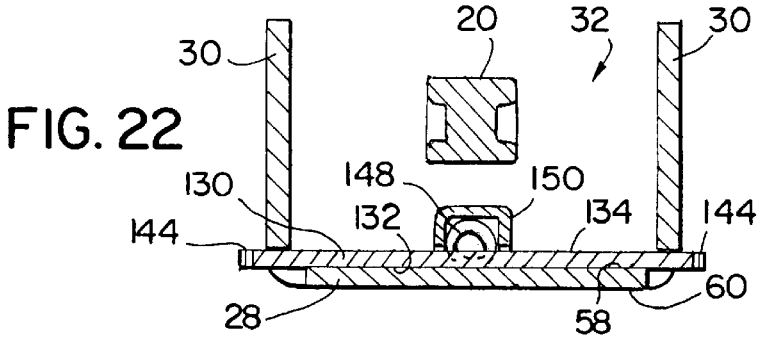
FIG. 22 is a cross-sectional view taken generally along line 22—22 of FIG. 11.

Referring back to FIG. 2, tool 10 also includes a plurality of secondary implements 20 pivotally attached to caddy 12 at second end 26. Secondary implements 20 may include a fish scaler, knife blades, screwdrivers, files, scissors or other tools. Secondary implements 20 are located along axle 38 and are separated by spacers 126 and latch spacers 40 which prevent accidental rotation of adjacent secondary implements 20 (FIG. 6). Each secondary implement 20 may be rotated from a retracted position, within internal channel 32 of caddy 12 (FIG. 18), to an extended position (FIG. 21) outside of caddy 12.

When secondary implement 20 is in the extended position, secondary implement 20 may be applied to a workpiece. Tool 10 includes a locking mechanism 128 which maintains secondary implement 20 in the extended position. As best illustrated in FIGS. 11 and 18–22, locking mechanism 128 includes a wedge 130. Wedge 130 is slidably mounted to top surface 58 of web 28 in internal channel 32 of caddy 12. Wedge 130 has a bottom planar surface 132 and a top surface 134. Top surface 134 has a first region 136 substantially parallel with bottom surface 132 and a second beveled region 138. Second beveled region 138 has an included angle of preferably nine degrees relative to a plane tangent to first region 136 of top surface 134. Wedge 130 also has a front edge 140 proximate second beveled region 138 and a rear edge 142 disposed opposite front edge 140.

Wedge 130 also includes a pair of concave extensions or buttons 144 (FIG. 11). Each concave web extension 144 is slidably received in a longitudinal slot 146 formed in the bottom of a respective side wall 30 of caddy 12. Longitudinal slots 146 are located proximate second end 26 of tool 10. Web extensions 144 project from side walls 30 and are movable along longitudinal slot toward and away from first end 24. Since web extensions 144 project from side walls 30 rather than from the top of cover 14 or the bottom of caddy 12, web extensions 144 occupy less space and provide a more compact tool 10.

Locking mechanism 128 further includes a spring 148. Spring 148 is a compression spring and is housed in a retainer 150 mounted to top surface 58 of web 28 by rivets or other fasteners. Thus, compression spring 148 is disposed between retainer 150 and wedge 130. Compression spring 148 includes a first end 152 and a second distal end 154. First end 152 is positively located by back 156 of retainer 150. Second end 154 contacts wedge 130. Spring 148 has a length sufficient to bias web extensions 144 toward second end 26 of tool 10.

Referring to FIGS. 18–22, secondary implement 20 includes a working portion 158 and a tang portion 160. Tang portion 160 includes a back edge 162, a locking surface 164 proximate back edge 162, an arcuate portion 166 extending from locking surface 164, and an opening tang 168 adjacent arcuate portion 166. In the preferred embodiment of the invention, locking surface 164 is at a seven degree angle relative to the top of secondary implement 20.

Figure 21:
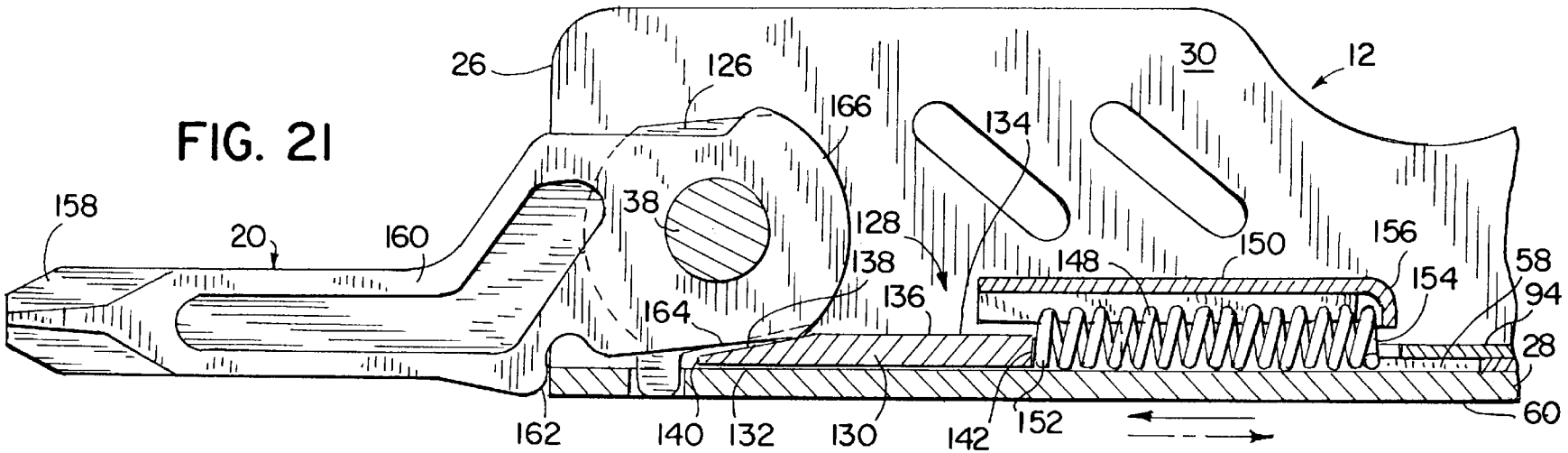
FIG. 21 is a partially sectional view of the locking mechanism showing the secondary implement in a fully extended position.

Referring to FIG. 21, locking mechanism 128 secures secondary implement 20 in the extended position such that secondary implement 20 cannot be rotated clockwise to the retracted position without manual retraction of wedge 130 by activation of wedge extensions 144. In this position wedge 130 is biased by compression spring 148 such that second beveled region 138 of wedge 130 is in contact with locking surface 164 of secondary implement 20. In the extended position, back edge 162 of secondary implement 20 is in contact with top surface 58 of web 28.

The relative angle between second beveled region 138 and locking surface 164 is selected by design for suitable operation of locking mechanism 120, i.e., to lock extended secondary implement 20 while preventing jamming. In addition, by design the point of contact of second beveled region 138 and locking surface 164 is behind the longitudinal axis of axle 38. This arrangement provides rotational lock up of secondary implement 20 in the extended position.

As illustrated in FIGS. 18–21, secondary implement 20 is rotated from the retracted position to the extended position by manual rotation of working portion 158. It is not necessary to manually retract wedge extensions 144 and wedge 130 to permit rotation of secondary implement 20 from the retracted position to the extended position. As secondary implement 20 is rotated from the retracted position, opening tang 168 engages front edge 140 of wedge 130 and forces wedge 130 away from second end 26 of tool 10. Once secondary implement 20 is in the extended position, compression spring 148 biases second beveled region 138 against locking surface 164 to lock secondary implement 20 in the extended position.

Figure 20:
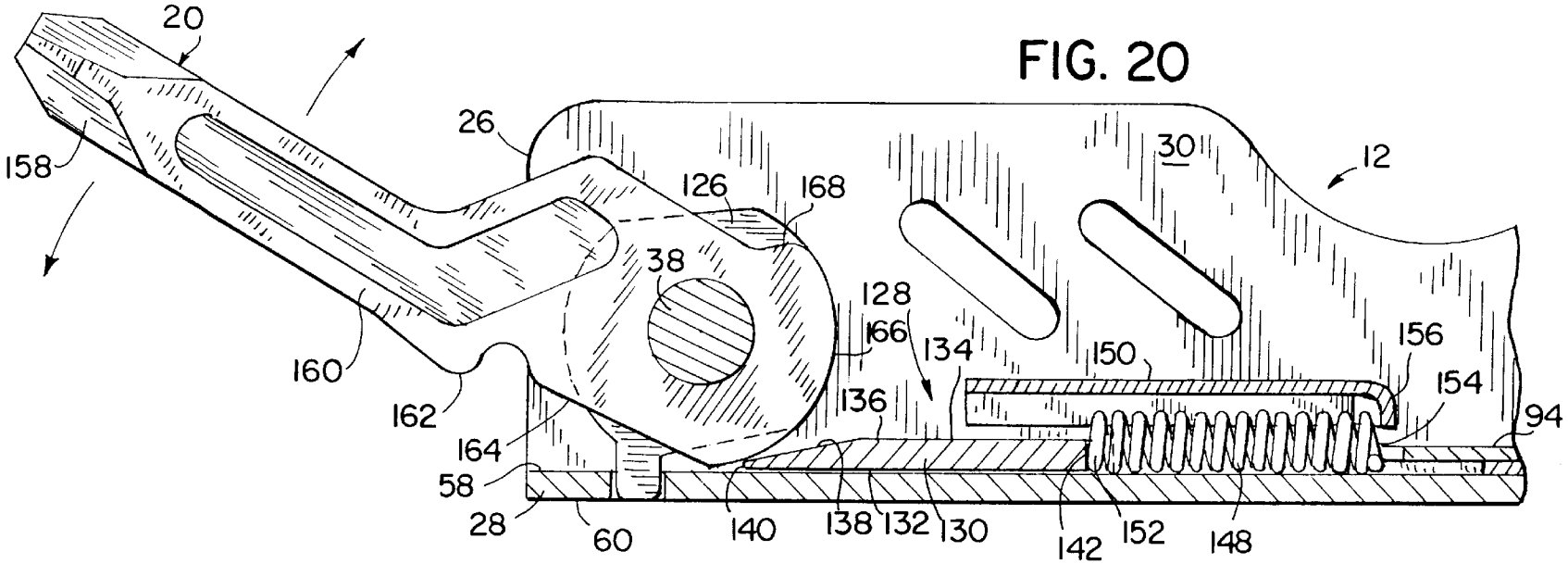
FIG. 20 is a partially sectional view of the locking mechanism showing the secondary implement in a further extended position.

As best shown in FIG. 20, arcuate portion 166 acts as a cam against front edge 140 of wedge 130 to maintain wedge extensions 144 in a retracted position as secondary implement 20 is being rotated between extended and retracted positions. Once arcuate portion 166 clears front edge 140 of wedge 130, spring 148 will bias wedge extensions 144 forward toward second end 26 of tool 10.

Referring to FIG. 21 secondary implement 20 is released from the locked, extended position by retraction of wedge 130 from locking surface 164. This is accomplished by translating wedge extensions 144 away from second end 26 of tool 10. A user applies a force to slide wedge extensions 144, thereby overcoming the force of spring 148. Once second beveled region 138 clears locking surface 164, secondary implement 20 may be rotated to the closed position.

It will be understood that the foregoing description is of a preferred embodiment of this invention and that the invention is not limited to the specific forms shown or described. For example, while the preferred embodiment shows a primary implement removably attached to the caddy, the primary implement may also be permanently attached. This and other modifications may be made in the design and arrangement of other elements without departing from the scope of the invention as expressed in the appended claims.

What is claimed is:

1. A multi-function tool comprising:

a caddy having first and second ends and an internal channel; and a cover pivotally connected to the caddy and rotatable between an open position in which the internal channel is exposed and a closed position in which the internal channel is covered, the cover including a light disposed about an end thereof, said cover including a button for activating the light;

said internal channel including spaced apart side walls joined by an intermediate web, one of said cover and said side walls including a pin mounted to permit rotation of said cover relative to said channel, and the other including means for detachably grasping the pin whereby said cover may be detached from and attached to said channel.

2. The multi-function tool of claim 1, wherein the cover includes an internal compartment formed therein and a hatch for closing the internal compartment.

3. The multi-function tool of claim 1, wherein the caddy includes an aperture formed in the first end, a web, and a pair of side walls extending from the web to form the internal channel.

4. The multi-function tool of claim 3, further comprising a primary implement attached to the first end.

5. The multi-function tool of claim 4, wherein the primary implement is removably attached to the first end and includes a tang having a post slidably received in the aperture.

6. The multi-function tool of claim 5, further comprising a locking mechanism for securing the primary implement to the caddy, the locking mechanism including a lock spring having an opening for engaging the post.

7. The multi-function tool of claim 4, wherein the primary implement is a pair of pliers.

8. The multi-function tool of claim 7, wherein the pliers includes a lock for securing the pliers in a closed position.

9. The multi-function tool of claim 4, wherein the primary implement is a wrench.

10. The multi-function tool of claim 1, wherein the cover includes an internal compartment formed therein and a hatch for closing the internal compartment.

11. The multi-function tool of claim 1 further comprising an axle extending transversely between the pair of side walls, and a plurality of implements pivotally connected to the axle for rotation from a retracted position within the internal channel to an extended position outside of the internal channel, the plurality of implements being covered by the cover when the of implements are in the retracted position and the cover is in the closed position.

12. The multi-function tool of claim 1, wherein the means for detachably grasping the pin includes resilient ears formed in each of the side walls, and means in each of said ears for receiving the terminal ends of said pin.

13. A multi-function tool comprising:

a caddy having first and second ends and an internal channel; and a cover pivotally connected to the caddy and rotatable between an open position in which the internal channel is exposed and a closed position in which internal channel is covered, the cover including a light disposed about an end thereof;

the caddy including an aperture formed in the first end, a web, and a pair of side walls extending from the web to form the internal channel;

a primary implement attached to the first end, wherein the primary implement is removably attached to the first end and includes a tang having a post slidably received in the aperture;

a locking mechanism for securing the primary implement to the caddy, the locking mechanism including a lock spring having an opening for engaging the post; and wherein the lock spring includes a base and a tang receiving portions, the base portion being connected to the web, the tang receiving portion being biased towards the cover and extending transversely between the pair of side walls, the opening being formed in the tang receiving portion.

14. The multi-function tool of claim 13, wherein the cover includes a light disposed about an end thereof.

15. The multi-function tool of claim 14, wherein the cover is detachable from the caddy.

16. A multi-function tool comprising:

a caddy including first and second ends, a web, and a pair of side walls extending from the web and forming an internal channel therewith;

a cover pivotally connected to the caddy and rotatable between an open position in which the internal channel is exposed and a closed position in which the internal channel is covered;

a primary implement attached to the first end of the caddy;

the caddy having an aperture formed in the first end, the primary implement being removably attached to the first end and including a tang having a post slidably received in the aperture;

a locking mechanism for securing the primary implement to the caddy, the locking mechanism including a lock spring having an opening for engaging the tang post;

wherein, the lock spring includes a base and a tang receiving portions, the base portion being connected to the web, the tang receiving portion being biased towards the cover and extending transversely between the side walls, the opening being formed in the tang receiving portion.

17. The multi-function tool of claim 16, wherein the primary implement is a pair of pliers.

18. The multi-function tool of claim 17, wherein the pliers includes a lock for securing the pliers in a closed position, the lock including a post slidable between a secured and a released position.

19. The multi-function tool of claim 16, wherein the primary implement is a wrench.

20. The multi-function tool of claim 16, wherein the cover includes a light disposed about an end thereof and a button for activating the light.

21. The multi-function tool of claim 20, wherein the cover is detachable from the caddy.

22. A multi-function tool comprising:

a caddy having first and second ends, a web and a pair of side walls extending from the web between the first and second ends and forming an internal channel, at least one side wall having a longitudinal slot proximate the second end, the caddy including an axle extending transversely between the pair of side walls proximate the second end;

a cover pivotally connected to the caddy and rotatable between an open position in which the internal channel is exposed and a closed position in which the internal channel is covered;

a primary implement removably attached to the first end of the caddy;

a plurality of secondary implements pivotally connected to the axle of the caddy, each secondary implement having a working portion and an opposed tang portion provided with a locking surface;

a first locking mechanism for locking each secondary implement in an extended position, a portion of the locking mechanism extending through the longitudinal slot;

the caddy including an aperture formed in the first end, and the primary implement including a tang having a post slidably received in the aperture; and a second locking mechanism for securing the primary implement to the caddy, the second locking mechanism including a lock spring mounted to the web and having an opening for engaging the post.

* * * * *